US012004631B1

(12) United States Patent
Nelson

(10) Patent No.: US 12,004,631 B1
(45) Date of Patent: Jun. 11, 2024

(54) APPLICATOR AND METHOD FOR REDUCING CROSS-CONTAMINATION IN WAXING

(71) Applicant: Michele Nelson, Chicago, IL (US)

(72) Inventor: Michele Nelson, Chicago, IL (US)

( * ) Notice: Subject to any disclaimer, the term of this patent is extended or adjusted under 35 U.S.C. 154(b) by 537 days.

(21) Appl. No.: 16/504,893

(22) Filed: Jul. 8, 2019

(51) Int. Cl.
*A45D 26/00* (2006.01)
*A45D 40/26* (2006.01)
*A45D 40/00* (2006.01)

(52) U.S. Cl.
CPC ..... *A45D 40/26* (2013.01); *A45D 26/0014* (2013.01); *A45D 2040/0012* (2013.01)

(58) Field of Classification Search
CPC .... A45D 40/26; A45D 40/28; A45D 26/0014; A45D 2040/0012; A45D 29/16; A45D 29/17; A61B 11/02; A61B 1/24; A61C 15/02
USPC ..... 600/240
See application file for complete search history.

(56) References Cited

U.S. PATENT DOCUMENTS 438,330 A * 10/1890 Truax ..... A61B 13/00 600/240
856,257 A * 6/1907 Hill ..... A61B 13/00 600/240
3,324,849 A * 6/1967 Kravitz ..... A61F 13/38 604/77
3,957,298 A * 5/1976 Purchase ..... A47G 21/10 294/99.2
5,891,019 A * 4/1999 Young ..... A61B 13/00 600/240
5,980,536 A * 11/1999 Jamali ..... A45D 26/0014 606/134
6,220,258 B1 * 4/2001 Briggs ..... A61C 15/02 132/321
6,754,930 B1 * 6/2004 Tsaur ..... A61M 35/006 15/210.1
7,507,936 B2 * 3/2009 Mast ..... A45D 26/0014 219/214
2005/0065411 A1 * 3/2005 Baldwin ..... A61B 13/00 600/240
2006/0200006 A1 * 9/2006 Drogin ..... A61B 13/00 600/240
2007/0148650 A1 * 6/2007 Brody ..... A61B 10/02 606/190
2008/0004635 A1 * 1/2008 McMillan ..... A45D 26/0014 606/134
2013/0104324 A1 * 5/2013 Greer, Jr. ..... A61C 5/50 15/104.93
2013/0276817 A1 * 10/2013 Holloway ..... A45D 40/26 132/320

(Continued)

FOREIGN PATENT DOCUMENTS

FR 2872004 A1 * 12/2005 ..... A45D 26/0014

OTHER PUBLICATIONS

Machine Translation Deissard (Year: 2004).*

*Primary Examiner* — Cris L. Rodriguez
*Assistant Examiner* — Brianne E Kalach
(74) *Attorney, Agent, or Firm* — Hibbs Law, LLC; Genna S. Hibbs

(57) ABSTRACT

This invention relates to a new device for waxing hair from skin, where used parts of a wax applicator can be removed from the applicator and unused parts then utilized to apply wax, thereby reducing the chances of contaminated wax from cross contaminating a primary wax source.

14 Claims, 2 Drawing Sheets

(56) References Cited

U.S. PATENT DOCUMENTS

| | | | | |
|---|---|---|---|---|
| 2014/0068874 | A1* | 3/2014 | Fusco | A61Q 9/04<br>132/212 |
| 2014/0157528 | A1* | 6/2014 | Fusco | A61P 31/02<br>8/161 |

* cited by examiner

APPLICATOR AND METHOD FOR REDUCING CROSS-CONTAMINATION IN WAXING

CROSS REFERENCE

This is an original application with no claims to benefit or priority.

BRIEF DESCRIPTION OF DRAWINGS

Non-limiting and non-exhaustive examples of several of the various embodiments of the present invention are described with references to the following figures, and reference numbers refer to the same features throughout the various views and embodiments unless otherwise specified.

Figure 1:
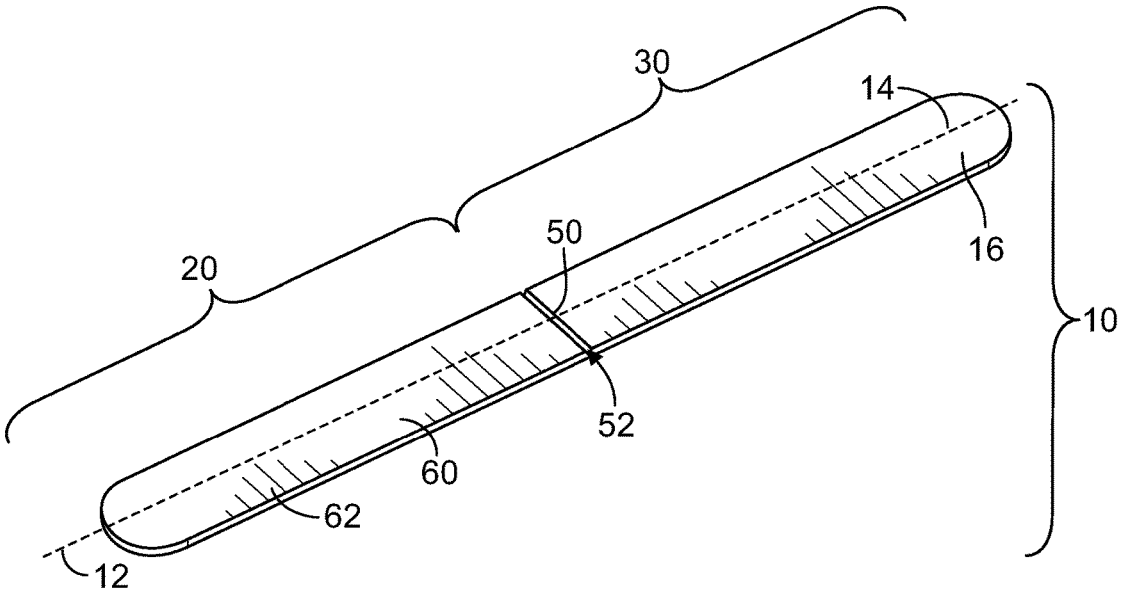
FIG. 1 is a top-front perspective of an embodiment of the invention, showing an applicator member that is a long, flat blade with rounded corners, showing only a single separable demarcation between a first part and a second part.

Corresponding reference characters indicate corresponding components throughout the several views of the drawings. Skilled artisans will appreciate that elements in the figures are illustrated for simplicity and clarity and have not necessarily been drawn to scale. Also, common but well-understood elements that are useful or necessary in a commercially feasible embodiment are often not depicted in order to facilitate a less obstructed view of these various embodiments. Additionally, the disclosed architecture is sufficiently configurable, such that it may be utilized in ways other than what is shown.

DETAILED DESCRIPTION OF INVENTION

In this Specification, which includes the figures, claims, and this detailed description, reference is made to particular and possible features of the embodiments of the invention, including method steps. These particular and possible features are intended to include all possible combinations of such features, without exclusivity. For instance, where a feature is disclosed in a specific embodiment or claim, that feature can also be used, to the extent possible, in combination with and/or in the context of other aspects and embodiments of the invention, and in the invention generally. Additionally, the disclosed architecture is sufficiently configurable, such that it may be utilized in ways other than what is shown.

The dimensions, size and shape of the various elements of the applicator member may be altered. Limitations that exist are related to dimensions, sizes, and shapes appropriate for use with a human hand and within the cosmetic waxing industry in general. Accordingly, the specific embodiments illustrated and described herein are for illustrative purposes only and the invention is not limited except by the claims.

The purpose of the Abstract of this Specification is to enable the U.S. Patent and Trademark Office and the public generally, and especially the scientists, engineers and practitioners of the art who are not familiar with patent or legal terms or phrasing, to determine quickly from a cursory inspection the nature and essence of the technical disclosure of the application. The Abstract is not intended to be limiting as to the scope of the invention in any way.

In the following description, numerous specific details are given in order to provide a thorough understanding of the present embodiments. It will be apparent, however, to one having ordinary skill in the art, that the specific detail need not be employed to practice the present embodiments. On other instances, well-known materials or methods have not been described in detail in order to avoid obscuring the present embodiments. When limitations are intended in this Specification, they are made with expressly limiting or exhaustive language.

Reference throughout this Specification to "one embodiment", "an embodiment", "one example" or "an example" means that a particular feature, structure, or characteristic described in connection with the embodiment or example is included in at least one embodiment of the present embodiments. Thus, appearances of the phrases "in one embodiment", "according to an embodiment", "in an embodiment", "one example", "for example", "an example", or the like, in various places throughout this Specification are not necessarily all referring to the same embodiment or example. Furthermore, the particular features, structures, or characteristics may be combined in any suitable combinations and/or sub-combinations in one or more embodiments or examples.

The terms "comprises", "comprising", "includes", "including", "has", "having", "can", "could", "could have" or their grammatical equivalents, are used in this Specification to mean that other features, components, materials, steps, etc. are optionally present as a non-exclusive inclusion. For instance, a device "comprising" (or "which comprises") components A, B, and C can contain only components A, B, and C, or can contain not only components A, B, and C but also one or more other components. For example, a method comprising two or more defined steps can be carried out in any order or simultaneously, unless the context excludes that possibility; and the method can include one or more other steps which are carried out before any of the defined steps, between two of the defined steps, or after all the defined steps, unless the context excludes that possibility.

Further, unless expressly stated to the contrary, "or" refers to an inclusive or and not to an exclusive or. For example, An embodiment could have optional features A, B, or C, so the embodiment could be satisfied with A in one instance, with B in another instance, and with C in a third instance, and probably with AB, AC, BC, or ABC if the context of features does not exclude that possibility.

Examples or illustrations given are not to be regarded in any way as restrictions on, limits to, or express definitions of any term or terms with which they are utilized. Instead, these examples or illustrations are to be regarded as being described with respect to one particular embodiment and as being illustrative only. Those of ordinary skill in the art will appreciate that any term or terms with which these example or illustrations are utilized will encompass other embodiments, which may or may not be given in this Specification, and all such embodiments are intended to be included within the scope of that term or terms. Language designating such nonlimiting examples and illustrations includes, but is not limited to "for example", "for instance", "etc.", "or otherwise", and "in one embodiment."

The phrase "at least" followed by a number is used to denote the start of a range beginning with that number, which may or may not be a range having an upper limit, depending on the variable defined. For instance, "at least I" means 1 or more.

In this specification. "a" and "an" and similar phrases are to be interpreted as "at least one" and "one or more." In this specification, the term "may" or "can be" or "could be" is to be interpreted as "may, for example." In other words, the term "may" is indicative that the phrase following the term "may" is an example of one of a multitude of suitable possibilities that may, or may not, be employed to one or more of the various embodiments.

The phrase "a plurality of" followed by a feature, component, or structure is used to mean more than one, specifically including a great many, relative to the context of the component. For example, "a plurality of widgets" means more than one, includes more than a few, and if contextually appropriate could include, hundreds of widgets on one device.

It is the applicant's intent that only claims that include the express language "means for" or "step for" be interpreted under 35 U.S.C. § 112. Claims that do not expressly include the phrase "means for" or "step for" are not to be interpreted under 35 U.S.C. § 112.

The disclosure of this patent document incorporates material which is subject to copyright protection. The copyright owner has no objection to the facsimile reproduction by anyone of the patent document or the patent disclosure, as it appears in the Patent and Trademark Office patent file or records, for the limited purpose required by law, but otherwise reserves all copyright rights whatsoever.

FIG. 1 is an embodiment of the invention, showing an applicator member 10 on a longitudinal plane 12, that is a long, flat blade 14 in the shape of a tongue depressor 16. It shows a single separable demarcation 50, which is a groove 52 between a first part 20 and a second part 30. The applicator member 10 is made from a rigid material 60, such as a smooth textured wood 62.

Figure 2:
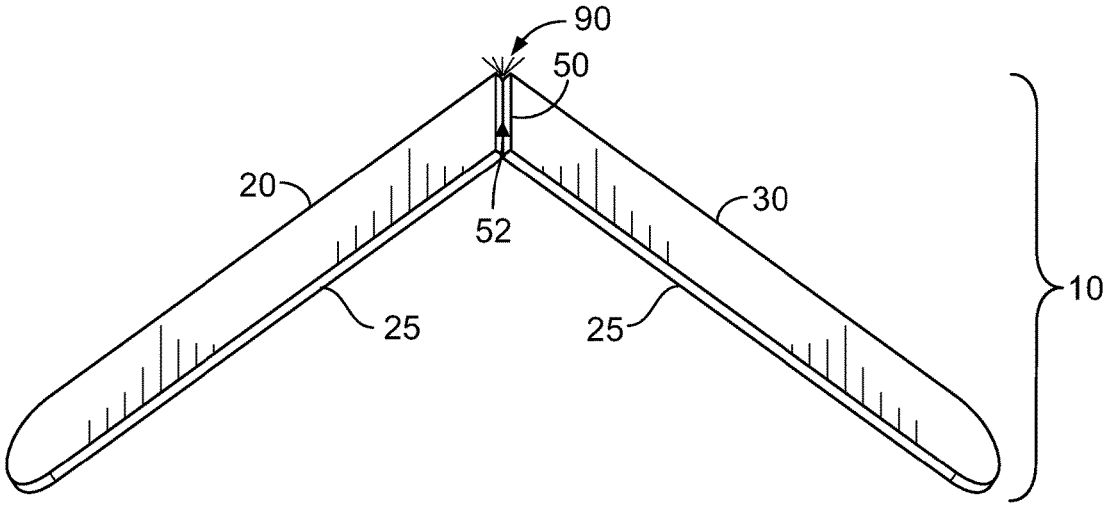
FIG. 2 is a top-front perspective and illustrates an embodiment of the invention similar to FIG. 1, but where the first part of the applicator member is breaking from the second part of the applicator member by means of a separable demarcation.

FIG. 2 illustrates an embodiment of the invention similar to FIG. 1, but where the substantially equal parts 25 of the applicator member 10, the first part 20 and the second part 30 are being intentionally snapped 90 by means of a separable demarcation 50 which is a groove 52.

Figure 3:
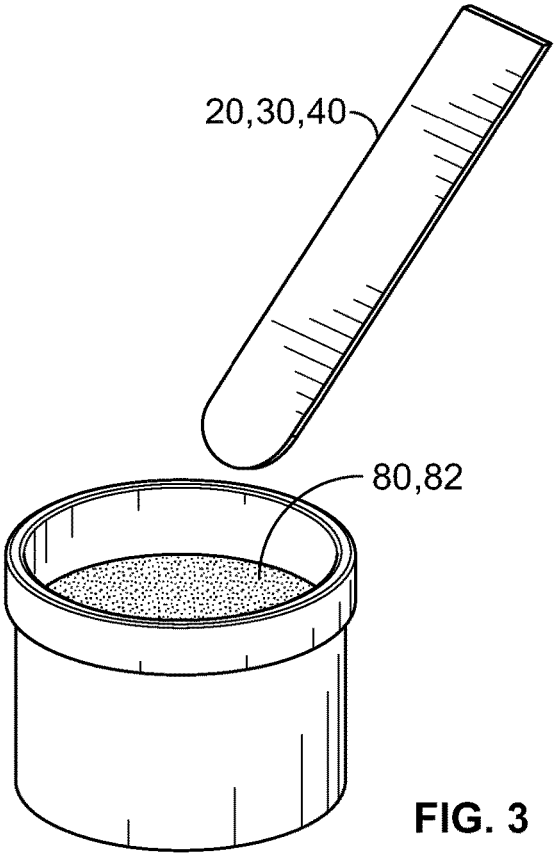
FIG. 3 is an example illustration of an embodiment of the invention where at least the first part of the applicator member has been separated, and the second part has been oriented to insert the rounded corners of the long, flat blade into a substance with fluid or semisolid properties.

FIG. 3 is an example illustration of an embodiment of the invention where the user separated an embodiment of the invention similar to FIGS. 1 and 2 into one of its parts-either the first part 20, the second part 30, or other possible parts 40. In this embodiment, the separated part is being dipped into a substance with fluid or semi-solid properties 80 like melted wax 82.

Figure 4A:
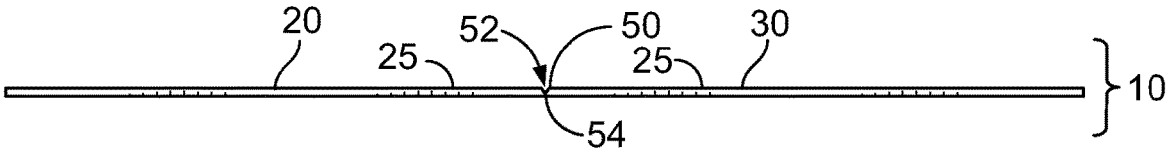
FIG. 4*a* is a side-view perspective of an embodiment of the invention with one separable demarcation.

FIG. 4*a* is an illustration of an embodiment of the invention with one separable demarcation 50. The separable demarcation 50 divides the applicator member 10 into substantially equal parts 25—first part 20 and a second part 30. The separable demarcation 50 which aides in separation of the first part 20 and the second part 30, can be a groove 52 or a perforated line 54.

Figure 4B:
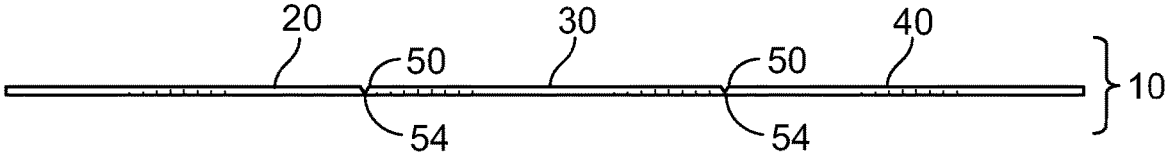
FIG. 4*b* is a side-view perspective of an embodiment of the invention with two separable demarcations.

FIG. 4*b* is an illustration of an embodiment of the invention with separable demarcations 50 that are two perforated lines 54. These separable demarcations 50 will divide the applicator member 10, by the action of the user, into—a first part 20, a second part 30, and other possible parts 40.

Figure 4C:
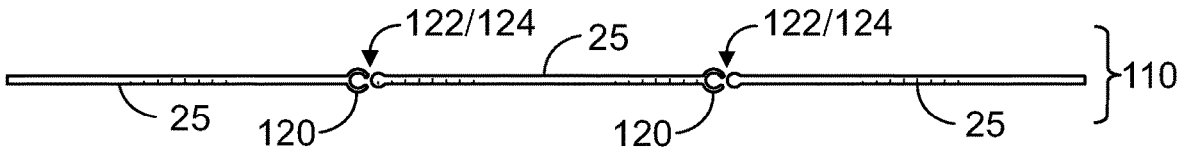
FIG. 4*c* is a side-view perspective of an embodiment of the invention showing a possible structure for an interlocking separation point.

FIG. 4*c* is an embodiment of the invention showing an interlocking application member 110 with two interlocking separation points 120 where the interlocking application member 110 snap fits 122 or annularly snap fits 124 into substantially equal parts 25. While FIG. 4*c* shows three parts, a person of ordinary skill in the art would understand that more parts can be included as long as it is not unwieldly for a user.

The first time a defined term is used in the claims language, it will be underlined and then defined in the description.

applicator member 10 means the body, frame, structure, or tool used to spread substances on skin. It can be made of any smooth material safe for human contact that is also sufficiently rigid/firm, so it does not snap or break needlessly. It can also be in any shape that allows for even spreading of a substance with fluid or semisolid properties. When using hot wax, the applicator member should also be made of a material that can maintain its integrity with limited exposure to the temperature of the hot wax. If it is made of a reusable material, it must be capable of surviving sanitation between uses as well.

longitudinal plane 12 means at least one long, relatively flat surface which runs along the body of the applicator member. In the case of embodiments involving a tongue depressor, such a member would have two longitudinal planes on opposite sides of the member. In other embodiments, there may be only one flat plane along the length while the remaining surface of the member could be rounded like the back of a spoon or a towel rod or otherwise round, or can be flat, or shaped for finger or hand grooves, or any geometrical shape.

long, flat blade 14 (with rounded corners) means a long, smooth surface with two longitudinal planes on opposite sides and is not sharp enough to cut through human skin with normal use.

tongue-depressor 16 means a thin, long, flat shaped tool made of smooth-textured, rigid material with rounded ends. A person of ordinary skill in the art would understand that tongue depressors are very common. They are easily available in all pharmacies in the United States and are widely sold by cosmetic suppliers. Tongue depressors are commonly made from materials like wood, plastic, metal, compostable plant matter, or a combination thereof. Birch wood is particularly common for single-use tongue depressors.

first part 20 means the end of the applicator member that is used first.

substantially equal parts 25 means that the applicator member, when separated into parts are generally of the same size. The individual parts are long enough to be comfortably held in hand by the user to spread a substance with fluid or semisolid properties.

second part 30 means the next part of the applicator member which would not be used until after the first part has been used and separated.

other possible parts 40 means more than two parts—the applicator member can be manufactured to be separated as parts of the whole into several parts by means of multiple demarcation points. When attached, these other possible parts would extend the length of the applicator member, but several embodiments can use shorter part lengths to some materials resulting in three (3) part embodiments, for example, of similar length to a large two-part embodiment. The length of the applicator member is only limited to the comfort of the user—as in, the length of the applicator member should not be unwieldly for the user to hold in hand and use in hair removal on human skin.

separable demarcation 50 means a breakable line, notch, perforation, joint, cleft, groove, snap, a pull apart, or an interlocking structure in or a part of the application member. This separable demarcation can run longitudinally or latitudinally to separate the application member into substantially equal parts. In the embodiments shown in the figures, the separable demarcations are latitudinal, but for large areas, a longitudinal break may be more advantageous.

groove 52 means a cut or indentation that runs along the width of the member. It encompasses perforated lines and other breaking methods that encourage a line break. The depth of the groove may be little more than a slight indentation or more than half of the thickness of the applicator member, or some other appropriate depth, so the applicator member stays together until intentionally snapped at the groove, cut, or indentation to separate parts by the user. The depth and type of groove will be somewhat dictated by material choice.

perforated line 54 means a groove that consists of punched holes in a line that runs perpendicular to the length of the applicator member.

rigid material 60 means a material which is not flexible or easily breakable under usual conditions of cosmetic waxing. The material of the applicator member should be stiff or unbending so that it will only separate when the user intentionally snaps or separates it into parts.

smooth-textured wood 62 means the common understanding that that the feel of the wooden applicator member is not rough to touch or abrasive on skin. This smooth-textured wood is commonly birch, balsa, pine, or redwood, but other woods can be used. Commercial factors often determine which woods are used, rather than function or efficacy.

size suitable for being held by hand means the length of the applicator member parts are comfortable to be held in hand by the user. This size can be custom to the length comfortable for a particular user, or offered in sizes like "large" or "small" as other hand-based products are offered.

substance with semisolid properties 80 means generally any goo, paste, wax, substance, plastic, substance, plastic, rubber, sap, sugar, beeswax, paraffin wax, or other materials without a set shape. The applicator can be used to spread such substance on skin with relative ease. This substance is an environmental component to the use of an embodiment of the invention, neither than a limitation to the invention.

melted wax 82 means a specific type of substance with fluid or semi-solid properties, specifically, liquid wax used to remove hair from human skin. There are different types of waxes available for the purpose of hair removal, including: hard wax, liquid wax, sugaring, heated soft wax, and a cold wax. Hard wax is the common type of melted wax. Hard wax is usually applied on to skin while it is still warm and is spread evenly on to skin. The hard wax can then be removed, along with hair, without a strip. However, a heated soft wax, the melted wax is spread on to skin and the hair is removed by using a strip. Both the hard or soft wax, must, at minimum be maintained at 40° C. (104° F.) to maintain fluidity, but can be as warm as 82.22° C. (180° F.). When the wax is warmer than 65.56° C. (150° F.), it becomes capable of killing bacteria, which is desirable. However, the ideal temperature range, in the cosmetic industry for wax application is between 48.80° C. (120° F.) and 76.67° C. (170° F.). At this temperature range, the wax is semi-solid/fluid, but not hot as to scald human skin. Clearly, when the ideal temperature range includes temperatures that are not warm to sufficiently kill bacteria, cross-contamination becomes a common issue. A cold wax works similar to the hard wax, but comes in its own strip and only needs to be warmed up by rubbing of hands. Last type of wax is called a sugar wax, which is made by melting sugar at 126.67° C. (260° F.). It is generally applied on to skin between 36.89° C. (98.4° F.) and 39.44° C. (103° F.) to safely apply the sugar wax so as to not scald human skin and still remove hair. The hair is removed when the sugar hardens on the skin and without using a strip.

intentionally snapped 90 means the willful action of the user of the applicator member to separate it into substantially equal parts. Not that the invention may never be unintentionally snapped or broken, but for the most part, in general use, the applicator member can withstand being used for its intended purpose without breaking along the separable demarcation.

Capable of maintaining the applicator member length means the separable demarcation, groove, perforated line, or interlocking separation point are structurally sound/strong enough to withstand the force/torque of having one part be held while another part is used to apply a substance with fluid or semisolid properties. In other words, that it is capable of withstanding the rigors of general use without separating.

user means a person who is applying a product or substance with fluid or semisolid properties on human skin and who is separating the applicator member into multiple substantially equal parts.

interlocking application member 110 means the area of the application member where parts engage with each other by overlapping or fitting together by means of an interlocking separation point.

interlocking separation point 120 means the point at which the overlapping or fitting structure of the interlocking application member separate. This is the reusable configuration allowing an application member to be reassembled, in contrast to a"groove," which is separated once and not re-attached. The overlapping or fitting structure is a general description of many possible configurations that a person of ordinary skill in the art would be familiar with in the art.

snap fit 122 means the commonly understood mechanism where an inner structure clicks in and out of another structure as intended by the user.

annular snap fit 124 means the commonly understood type of snapping mechanism where the inside of the separation point is rounded, and the outer end is an open half circle. The rounded end of the separation points snuggly fits into the open half circle, creating the length of the applicator member.

One embodiment of the invention is comprised of an applicator member with at least a first part and a second part. The first part, second part, and other possible parts of the applicator member are separable by a separable demarcation. The applicator member is made of a rigid material making it to be comfortably used by the user. In this embodiment either the entire applicator member or each separated part of the applicator member is of a size suitable for being held by hand and is used to apply a substance with fluid or semisolid properties.

A second embodiment of the invention is the applicator member having a first part, a second part, and other possible parts. In this embodiment, the applicator member has at least one longitudinal plane which is at least one long, relatively flat surface which runs along the body of the applicator member.

A third embodiment of the invention is the applicator member having a first part, a second part, and other possible parts. In this embodiment, the applicator member is a long, flat blade with rounded corners; i.e., the applicator member has two longitudinal planes on opposite sides. The blade is not sharp enough to cut through human skin.

A fourth embodiment of the invention is the applicator member where the applicator member is in the shape commonly known as a tongue depressor. Here, the applicator member is in the shape of a long, thin, flat tool.

A fifth embodiment of the applicator member where the applicator member only has a first part and a second part which are separated by a separable demarcation.

A sixth embodiment of the invention is the applicator member where the applicator member only has a first part and a second part separated by a separable demarcation. In this embodiment, the first part and the second part of the applicator member are substantially equal in size.

A seventh embodiment of the invention is the applicator member where the applicator member has a first part, a second part, and other possible parts which are separated by a separable demarcation. In this embodiment, the separable demarcation runs across the breadth of the applicator member and is a groove. This groove holds the parts of the applicator member, thus maintaining the length of the applicator member until it is intentionally snapped by the user at the groove.

An eighth embodiment of the invention is the applicator member where the applicator member has a first part, a second part, and other possible parts which are separated by a separable demarcation. In this embodiment, the separable demarcation runs across the breadth of the applicator member and is a perforated line. The perforated line holds the parts of the applicator member, thus maintaining the length of the applicator member until it is intentionally snapped by the user at the perforated line.

A ninth embodiment of the invention is the applicator member comprises of the applicator member with a first part, second part, and other possible parts. The applicator member itself is like the applicator member in the first embodiment. In this embodiment, the applicator member is made of a rigid material, which is a smooth-textured wood.

A tenth embodiment of the invention is the applicator member comprises of the applicator member with a first part, second part, and other possible parts. The applicator member itself is like the applicator member in the first embodiment. In this embodiment, the applicator member is further capable of applying a substance with fluid or semisolid properties, like melted wax on to human skin.

An eleventh embodiment of the invention is the interlocking application member comprises of at least a first part and a second part. The first part, second part, and other possible parts of the interlocking application member are separable by an interlocking separation point. The interlocking separation point in this embodiment can maintain the length of the application member until intentionally snapped by the user. In this embodiment, the interlocking application member is made of a rigid material making it to be comfortably used by the user. In this embodiment either the entire application member or each separated part of the application member is of a size suitable for being held by hand and is used to apply a substance with fluid or semisolid properties.

A twelfth embodiment of the invention is the interlocking application member, which is like the interlocking application member in the eleventh embodiment. In this embodiment, the interlocking separation point is a snap fit.

A thirteenth embodiment where the interlocking application member, which is like the interlocking application member in the eleventh embodiment. In this embodiment, the interlocking separation point is an annular snap fit. It is a commonly understood mechanism where the inner structure of one-part clicks in and out of the outer structure of another part.

A method of using another embodiment of the invention is either the applicator member similar to the applicator member in the first embodiment or the interlocking application member similar to the interlocking application member in the eleventh embodiment can be used to wax human hair. In this method to use an embodiment of the invention, the first part of either the applicator member or the interlocking application member is available to be used. The first part is then dipped into melted wax or soft wax and then used to spread the wax on human skin making it ready for hair removal. Once the first part is used, either the applicator member or the interlocking application member is separated at the separable demarcation or the interlocking separation point making the successive parts of the applicator member or the interlocking application member ready to apply wax for hair removal.

What is claimed is:

1. A method for waxing human hair with reduced cross-contamination, comprising the sequential steps of:

holding an applicator member such that a first part is available to be used;

dipping the first part of the applicator member into a melted or soft hair removal wax, and loading the first part of the applicator member with a first amount of the melted or soft hair removal wax;

spreading an amount of the loaded melted or soft hair removal wax from the first part of the applicator member onto an area for hair removal;

separating the first part of the applicator member from a second portion of the applicator member at a first line of separability extending across a width of the applicator member;

discarding the first part of the applicator member;

dipping the second part of the applicator member into the melted or soft hair removal wax and loading the second part of the applicator member with a second amount of the melted or soft hair removal wax;

spreading an amount of the loaded melted or soft hair removal wax from the second part of the applicator member on an area for hair removal.

2. The method of claim 1, further comprising a step of separating a third part of an applicator member from the second part of the applicator member at a second line of separability, and subsequently dipping the third part of the applicator member into the melted or soft hair removal wax, loading the third part of the applicator member for use.

3. The method of claim 1, where the first line of separability is a frangible line of demarcation comprising a breakable line, notch, perforation, groove, or pull apart structure.

4. The method of claim 2, where the second line of separability is a frangible line of demarcation comprising a breakable line, notch, perforation, groove, or pull apart structure.

5. The method of claim 1, where the first line of separability is formed by an interlocking structure or snap fit.

6. The method of claim 2, where the first line of separability is formed by an interlocking structure or snap fit.

7. The method of claim 1, where the applicator member is configured as a long, flat blade with rounded corners.

8. The method of claim 2, where the applicator member is configured as a tongue-depressor.

9. The method of claim 1, where the first and second parts of the applicator member are substantially equal halves of the applicator member.

10. The method of claim 2, where the first, second and third parts of the applicator member are substantially equal thirds of the applicator member.

11. The method of claim 1, where the first line of separability is capable of maintaining a connection between the first and second parts of the applicator until they are forcefully separated by a user.

12. The method of claim 5, where the first line of separability is capable of maintaining a connection between the first and second portions of the applicator until they are forcefully snapped by a user.

13. The method of claim 1, where the applicator member is made from a smooth-textured wood.

14. A waxing system for removing human hair comprising:

an applicator member for applying a material with fluid or semisolid property; and a wax material with fluid or semisolid properties for removing human hair;

wherein the applicator member comprises:

a rigid body made of smooth wood and extending as a flat blade with rounded corners along a longitudinal plane;

the rigid body comprising at least a groove extending across its width, separating the rigid body into at least a first part and a second part;

the groove forming a separable demarcation line which forms a frangible connection between the first and second part configured to allow the connection to withstand use of the applicator by the user, while allowing for intentional separation of the respective first and second parts at the demarcation line by snapping;

the at least first part and second part of the rigid body of the applicator member each comprise opposing surfaces that are each defined by a respective smooth planar side along their respective lengths;

each of the separated first and second parts, in addition to the entirety of the applicator member is adapted for being held by a user and used to apply the wax material with fluid or semisolid properties; and the applicator member extends linearly along a central axis across the at least first part and the second part of the applicator member such that the planar side of each part is adjacent and forming a contiguous smooth planar side of the applicator member.

* * * * *